US011066784B2

(12) United States Patent
Parkås et al.

(10) Patent No.: US 11,066,784 B2
(45) **Date of Patent: *Jul. 20, 2021**

(54) METHOD FOR MANUFACTURING DISSOLVING PULP

(71) Applicant: Södra Skogsägarna ekonomisk förening, Växjö (SE)

(72) Inventors: Jim Parkås, Varberg (SE); Harald Brelid, Gothenburg (SE)

(73) Assignee: SÖDRA SKOGSÄGARNA EKONOMISK FÖRENING

( * ) Notice: Subject to any disclaimer, the term of this patent is extended or adjusted under 35 U.S.C. 154(b) by 0 days.

This patent is subject to a terminal disclaimer.

(21) Appl. No.: 16/469,437

(22) PCT Filed: Dec. 21, 2017

(86) PCT No.: PCT/EP2017/084109
§ 371 (c)(1),
(2) Date: Jun. 13, 2019

(87) PCT Pub. No.: WO2018/115290
PCT Pub. Date: Jun. 28, 2018

(65) Prior Publication Data

US 2019/0390404 A1 Dec. 26, 2019

(30) Foreign Application Priority Data

Dec. 23, 2016 (SE) ..... 1651739-3

(51) Int. Cl.
*D21C 9/02* (2006.01)
*D21C 3/26* (2006.01)
(Continued)

(52) U.S. Cl.
CPC ..... *D21C 3/263* (2013.01); *D21C 1/02* (2013.01); *D21C 3/022* (2013.01); *D21C 3/026* (2013.01);
(Continued)

(58) Field of Classification Search
USPC ..... 162/14
See application file for complete search history.

(56) References Cited

U.S. PATENT DOCUMENTS 8,500,956 B2 8/2013 Sixta et al.
2015/0136346 A1* 5/2015 Bogren ..... D21C 9/004 162/41

FOREIGN PATENT DOCUMENTS

CN 102985610 A 3/2013
JP 2015183317 A 10/2015
(Continued)

OTHER PUBLICATIONS

International Search Report for PCT/EP2017/084109 dated Feb. 6, 2018.
(Continued)

*Primary Examiner* — Jacob T Minskey
(74) *Attorney, Agent, or Firm* — Tarolli, Sundheim, Covell & Tummino LLP

(57) ABSTRACT

A method for manufacturing dissolving pulp using wood material is disclosed. The method comprises
subjecting the wood material to a hydrothermal treatment using steam and/or water,
digesting the wood material obtained to a pulp in a kraft cooking process;
subjecting the pulp to a cold caustic extraction CCE; and
dewatering, washing and pressing the pulp to get a pulp product having a carbohydrate content.
The wood material can be a coniferous wood material, and whereby the mild hydrothermal treatment is performed to
(Continued)

reach a P-factor of from 100-300, and whereby the cold caustic extraction is executed to reach a combined concentration of anhydromannose and anhydroxylose of 5 weight %, or less, of the carbohydrate content of the pulp product.

15 Claims, 9 Drawing Sheets

(51) Int. Cl.

| | |
|---|---|
| ***D21C 1/02*** | (2006.01) |
| ***D21C 3/02*** | (2006.01) |
| ***D21C 9/18*** | (2006.01) |
| ***D21C 11/00*** | (2006.01) |

(52) U.S. Cl.
CPC ..... *D21C 9/02* (2013.01); *D21C 9/18* (2013.01); *D21C 11/0007* (2013.01)

(56) References Cited

FOREIGN PATENT DOCUMENTS

| | | | |
|---|---|---|---|
| RU | 2012151858 | | 6/2014 |
| WO | 99/47733 | A1 | 9/1999 |
| WO | 2011/138633 | A1 | 11/2011 |
| WO | 2011/138634 | A1 | 11/2011 |
| WO | 2013/004909 | A1 | 1/2013 |
| WO | 2013/178608 | A1 | 12/2013 |
| WO | 2016/079045 | A1 | 5/2016 |

OTHER PUBLICATIONS

International Written Opinion for PCT/EP2017/084109 dated Feb. 6, 2018.
Chinese Office Action for Application No. 201780030293.0 dated May 26, 2021.
Russian Search Report for Application No. 2019118876/03(036371) dated Mar. 31, 2021.

* cited by examiner

Table 1.

| Pulp No. | P-factor | Max temp. Hydro-thermal treatment (°C) | H-factor | EA-charge (%) | Residual EA (g/l) | Kappa number | Pulp yield (% on wood) | Anhydro-glucose (% of carbo-hydrates) | Anhydro-xylose (% of carbo-hydrates) | Anhydro-mannose (% of carbo-hydrates) | Kappa number after O2 |
|---|---|---|---|---|---|---|---|---|---|---|---|
| 1 | 0 | --- | 1200 | 19.5 | 8.0 | 30.7 | 48.5 | 85.4 | 7.3 | 6.3 | 9.5 |
| 2 | 50 | 150 | 1200 | 19.5 | 5.9 | 28.9 | 46.0 | 88.8 | 5.6 | 5.2 | 8 |
| 3 | 100 | 160 | 1200 | 21.0 | 6.9 | 23.4 | 42.8 | 91.6 | 4.2 | 4.0 | 6 |
| 4 | 100 | 160 | 1150 | 21.0 | 7.0 | 24.5 | 43.1 | 91.5 | 4.3 | 4.0 | 5.5 |
| 5 | 150 | 160 | 1150 | 21.4 | 6.4 | 24.3 | 41.9 | 93.2 | 3.5 | 3.2 | 5.3 |
| 6 | 200 | 170 | 1150 | 21.4 | 6.6 | 22.7 | 41.0 | 94.5 | 3 | 2.5 | 4.9 |
| 7 | 200 | 160 | 1150 | 21.8 | 7.8 | 20.8 | 40.9 | 94.3 | 3.1 | 2.5 | 4 |
| 8 | 400 | 170 | 1150 | 22.5 | 7.5 | 25 | 38.5 | 96.3 | 2.2 | 1.5 | 4 |
| 9[1] | 600 | 160 | 1150 | 23.0 | 7.5 | 31.6 | 38.3 | 97.1 | 1.8 | 1.1 | 2.6 |

[1]Reference pulp

Fig. 2

Table 2.

| Pulp No. | EA (g/l) | Sodium borate (g/l) | Anhydro-glucose (% of carbo-hydrates) | Anhydro-xylose (% of carbo-hydrates) | Anhydro-mannose (% of carbo-hydrates) |
|---|---|---|---|---|---|
| 1 | 70 | 0 | 90.9 | 2.7 | 6.1 |
| 1 | 70 | 40 | 91.6 | 3.3 | 4.7 |
| 1 | 85 | 0 | 92.0 | 2 | 5.7 |
| 1 | 85 | 40 | 93.6 | 2.4 | 3.7 |
| 1 | 100 | 0 | 93.2 | 1.5 | 5.1 |
| 1 | 100 | 40 | 95.6 | 1.5 | 2.7 |
| 2 | 85 | 0 | 93.8 | 1.6 | 4.5 |
| 2 | 85 | 40 | 94.9 | 2.0 | 3 |
| 3 | 85 | 0 | 95.5 | 1.1 | 3.3 |
| 3 | 85 | 40 | 96.0 | 1.7 | 2.2 |
| 4 | 85 | 0 | 95.2 | 1.3 | 3.4 |
| 5 | 85 | 0 | 96.2 | 1.2 | 2.6 |
| 6 | 70 | 0 | 96.2 | 1.5 | 2.2 |
| 6 | 70 | 40 | 96.5 | 1.8 | 1.7 |
| 6 | 85 | 0 | 96.8 | 1.1 | 2.0 |
| 6 | 85 | 40 | 97.3 | 1.3 | 1.4 |
| 7 | 85 | 0 | 96.8 | 1.1 | 2.1 |
| 8 | 70 | 0 | 97.6 | 1.2 | 1.3 |
| 8 | 70 | 40 | 97.4 | 1.5 | 1.1 |
| 8 | 85 | 0 | 97.9 | 0.9 | 1.2 |
| 8 | 85 | 40 | 97.9 | 1.1 | 0.9 |

Fig. 3

Table 3.

| Pulp No. | O2 (%) | CCE-stage (%) | Bleaching (%) | Total yield (% on wood) | Anhydro-glucose (% of carbo-hydrates) | Anhydro-xylose (% of carbo-hydrates) | Anhydro-mannose (% of carbo-hydrates) | Calculated cellulose yield (% on wood) |
|---|---|---|---|---|---|---|---|---|
| 4 | 95.9 | 95.2 | 97.9 | 38.5 | 95.2 | 1.2 | 3.3 | 36.5 |
| 5 | 95.5 | 97.0 | 98.1 | 38.1 | 96.2 | 1.1 | 2.5 | 36.5 |
| 7 | 96.7 | 96.9 | 98.3 | 37.7 | 96.8 | 1.0 | 2.0 | 36.3 |
| 9[1] | 95.1 | - | 98.2 | 35.8 | 97.9 | 1.6 | 1.0 | 34.7 |

[1]Reference pulp

Fig. 4

Table 4.

| Pulp no. | 4 | 5 | 7 | 9 | Reference A[2] Hardwood PHK, TCF | Reference B[2] Hardwood Acid sulfite, ECF |
|---|---|---|---|---|---|---|
| Brightness (% ISO) | 92.5 | 93.1 | 92.8 | 92.1 | 89.0 | 93.0 |
| Acetone extractives (%) | 0.1 | 0.1 | 0.1 | 0.1 | 0.1 | 0.2 |
| Intrinsic viscosity (ml/g) | 453 | 484 | 433 | 477 | 450 | 500 |
| Anhydroglucose (% of carbohydrates) | 95.2 | 96.2 | 96.8 | 97.3 | 96.3 | 97.0 |
| Anhydroxylose (% of carbohydrates) | 1.2 | 1.1 | 1.0 | 1.6 | 3.5 | 2.5 |
| Anhydromannose (% of carbohydrates) | 3.3 | 2.5 | 2.0 | 1.0 | 0.2 | 0.5 |
| $R_{10}$ alkali resistance (%) | 93.6 | 94.8 | 94.4 | 92.5 | 92.0 | 89.0 |
| $R_{18}$ alkali resistance (%) | 95.1 | 96.3 | 96.6 | 96.7 | 96.5 | 95.0 |

[2] "Handbook of pulp", Sixta. H. ed., pp. 1061-1062, Wiley-VCF Verlag GmbH & Co. KGaA, 2006

Fig. 5

Table 5

| Pulp No | 4 | 5 | 7 | 9 |
|---|---|---|---|---|
| P-factor | 100 | 150 | 200 | 600 (ref. without CCE) |
| Shape factor non-dried (%) | 73.5 | 73.2 | 73.4 | 79.2 |
| Shape factor dried (%) | 75.9 | 74.8 | 75.4 | 81.9 |
| Xyl * | 1.2 | 1.1 | 1.0 | 1.6 |
| Man * | 3.3 | 2.5 | 2.0 | 1.0 |
| Xyl+Man * | 4.5 | 3.6 | 3.0 | 2.6 |
| Xyl/(Xyl+Man)x100 | **26.7** | **30.6** | **33.3** | **61.5** |

*=weight % of the carbohydrate content of the pulp product

Fig. 8

METHOD FOR MANUFACTURING DISSOLVING PULP

RELATED APPLICATIONS

The present invention is a U.S. National Stage under 35 USC 371 patent application, claiming priority to Serial No. PCT/EP2017/084109, filed on 21 Dec. 2017; which claims priority of SE 1651739-3, filed on 23 Dec. 2016, the entirety of both of which are incorporated herein by reference.

TECHNICAL FIELD

The present disclosure relates to a method for manufacturing dissolving pulp using wood material and especially coniferous wood material. The method includes the steps of treating the wood material with a hydrothermal treatment to a selected P-factor and subsequently performing a cold caustic extraction, CCE.

BACKGROUND

Dissolving pulp, also known as dissolving cellulose, is a bleached wood pulp that has high cellulose content and which is generally produced from wood by chemical pulping using a sulfite process or a prehydrolysis-kraft (PHK) process. The kraft process without any preceding prehydrolysis step is a commonly used pulping process for the production of papermaking pulps. In a conventional kraft process, wood is treated with an aqueous mixture of sodium hydroxide and sodium sulfide. This treatment degrades and solubilizes lignin leading to defibration of the wood fibers.

Furthermore, in conventional manufacturing of dissolving pulps by kraft processes including a pre-hydrolysis step, the hydrothermal treatment in the pre-hydrolysis step leads to an extensive hydrolysis of the carbohydrates in the wood materials. Not only the hemicelluloses are hydrolyzed but also the cellulose to some extent. This means that the conventional PHK process suffers from low cellulose yield due to the harsh conditions needed to remove the hemicelluloses in the pre-hydrolysis step.

A process solution using steam activation before cooking and a cold caustic extraction (CCE) step is disclosed in the published international patent application no. WO 2013/178608 A1, Södra Cell A B, Chemiefaser Lenzing A G. The document discloses a hardwood pulp process. A CCE step is provided to reduce the anhydroxylose content. The document establishes that the process is very favorable when using hardwood as hardwood has a high anhydroxylose content and the anhydroxylose can easily be removed using the CCE step. The document further discloses that various conifers, such as spruce and pine are less suitable for use in alkali based pulp process such as the dissolving pulp processes disclosed in the document. Conifers have up until now been deemed unsuitable as the amount of anhydromannose from conifers is relatively high and as anhydromannose is very difficult, if at all possible, to dissolve in a CCE step. Consequently, no efficient dissolving pulp process based on coniferous raw material with a CCE step as the hemicellulose removing process step has been available.

The industrial importance of dissolving pulp has increased during the last decade as the production of viscose fibers from dissolving pulps has increased. Efficiency and competitiveness for dissolving pulp producers are dependent on pulp yield, energy consumption and production rate.

There is a need for an improved high yield pulping process which does not compromise with the quality of the pulp.

SUMMARY

It is an object of the present disclosure to provide a dissolving pulp process which gives a high cellulose yield and yet produces a dissolving pulp with low hemicellulose content and good quality. It is an object of the present invention to solve or at least alleviate one or more of the problems set out above by providing a method for manufacturing dissolving pulp using wood material, the method comprising the steps of;

a) subjecting the wood material to a hydrothermal treatment using steam and/or water,
b) digesting the wood material obtained from step a) to a pulp in a kraft cooking process, optionally followed by an oxygen delignification step; and
c) subjecting the pulp to a cold caustic extraction CCE; and
d) dewatering, washing and pressing the pulp to get a pulp product having a carbohydrate content, 1. The wood material is coniferous wood material, and the hydrothermal treatment is performed to until a P-factor of from 100-300 is reached. The cold caustic extraction is executed to reach a combined concentration of anhydromannose and anhydroxylose of 5 weight % or less of said carbohydrate content of said pulp product, preferably in the range of from 2.5 to 4.5 weight % of said carbohydrate content of said pulp product.

Also according to a further aspect of the present invention there is provided a dissolving pulp obtainable by the method as set out above.

In an additional aspect there is also provided a dissolving pulp made from coniferous wood material characterized by having a shape factor of from 73 to 80% in dry form, preferably from 74 to 76% in dry form, and/or having a ratio of anhydroxylose in relation to anhydroxylose and anhydromannose of from 20 to 40%, wherein said pulp preferably is made using the above method.

The method as disclosed herein fills the currently existing gap between a low yield PHK process and the known, but environmentally questionable, possibility to use borate extraction in combination with cold alkaline extraction for post-extraction of hemicelluloses to produce low hemicellulose pulp. By a method according to the present disclosure, a high-quality dissolving pulp may be provided at high yield without the use of additives such as borate and with less vigorous hydrothermal treatment than has heretofore been possible. This is achieved by the combination of a mild hydrothermal treatment followed by a cold caustic extraction. The method provides a solution to the problem with high anhydromannose concentrations in conifer based pulp, which a cold caustic extraction step has not previously been able to remedy to a sufficiently high degree. The method as disclosed herein has been found to provide a dissolving pulp having favorable properties even at a high cellulose yield. Manufacturing dissolving pulp in accordance with the disclosed method is thus cost effective and environmentally friendly as it may reduce or eliminate the need for using additives such as borate in the process. Findings thus now indicate that wood from conifers, such as spruce or pine, may still be an option if treated in accordance with the method disclosed herein.

The method includes the steps of treating the wood material with a hydrothermal treatment to a selected P-factor and subsequently performing a cold caustic extraction, CCE.

It has been found that a combination of these steps during specified conditions provides a high cellulose yield without compromising the quality of the dissolving pulp.

The hydrothermal treatment may be performed such that a P-factor of from 100-300 is reached, preferably 100-250, more preferably of from 150-250. It has been found that the hydrothermal treatment of the wood material may be relatively mild, yet give the appropriate effect when combined with the CCE-step. The selected P-factor contributes to a comparatively low degree of breakdown of the cellulose molecules, yet surprisingly gives a high yield of pulp with a low content of anhydromannose and anhydroxylose.

The cold caustic extraction may be executed such that the resulting anhydromannose concentration and anhydroxylose concentration after step d) of the pulp product is ≤4.0 weight % of the carbohydrate content of the pulp product. By maintaining a relatively mild hydrothermal treatment below conventional levels of hydrothermal treatment combined with a CCE step, the anhydromannose and anhydroxylose concentration may be lowered even further. Conventional hydrothermal treatment is generally performed to a P-factor to about 600-800.

The coniferous wood material obtained from step a) may be treated until the anhydromannose concentration after step d) is from 1.5-3.5 weight % of the carbohydrate content in the pulp product and/or the wood material obtained from step a) may be treated until the anhydroxylose concentration after step d) is from 1.0-1.5 weight %, of the carbohydrate content in the pulp product. It has been found that the method may provide an end product with very low amounts of anhydromannose and anhydroxylose by a relative mild hydrothermal treatment in combination with a CCE step.

The cold caustic extraction step in step c) may comprise one or more of the steps of;

- adding industrial white liquor, preferably without the addition of borate salts, to the pulp;
- keeping the temperature at 40° C.-60° C. for at least 5 minutes, preferably 40° C.-50° C., and optionally
- using an alkali concentration in the liquid phase of the pulp suspension in the range of from 60-150 g/l, preferably of from 70-120 g/l, more preferably of from 80-100 g/l.

The method as disclosed herein has surprisingly been found to provide good results in terms of removal of anhydromannose and anhydroxylose from the pulp and with a surprisingly high cellulose yield, even without additives such as borate salts.

The wood material may be coniferous wood material comprising at least 8 weight % of anhydromannose, 12 weight % or less of anhydroxylose, and the remaining material being other wood components such as cellulose, lignin, extractives and other carbohydrates. It has been found that the method may be applied on coniferous wood material with relatively high weight percentage of anhydromannose.

The wood material is preferably at least one coniferous wood material selected from the list of; spruce, pine, fir, larch and hemlock.

The term P-factor as used herein is determined using the following formula, wherein T is temperature in Kelvin and t is treatment time in hours.

$$P-factor = \int_0^t \frac{k(T)}{k_{100^\circ\,C.}}\,dt = \int_0^t e^{40.48-\frac{15106}{T}}\,dt$$

The P-factor may be reached by a heat treatment at a selected temperature for a selected period of time. A P-factor between 150 and 300 may be reached via one or more of the following settings; treatment at about 130° C. for 442 to 885 minutes, at about 140° C. for 179 to 357 minutes, at about 150° C. for 75 to 151 minutes, at about 160° C. for 33 to 66 minutes and/or at about 170° C. for 15 to 30 minutes. The P-factor achieved will be determined by the temperature profile during the treatment time, since the P-factor combines the effect of time and temperature in one single parameter. For an advantageous combination of process control and retention time during the hydrothermal treatment, the maximum temperature is normally between 140° C. and 180° C., preferably between 145° C. and 170° C. To minimize the time needed for hydrothermal treatment it is advantageous to increase the temperature to the selected maximum temperature as fast as possible. However, it is important to secure that all parts of the wood raw material are subjected to a similar P-factor.

The term "shape factor" refers to the ratio of the maximum extension length of the fibre (projected fiber length) to the true length of the fibre (along the fibre contour) here expressed in %. Shape factor is thus l/L*100 where l is the projected length and L is the true length.

The term "dissolving pulp", as used herein, is intended to define a pulp having high cellulose content and low content of lignin and hemicellulose. The dissolving pulps are classified depending on their content of alpha-cellulose. Depending on the applications, different content of alpha cellulose is required. Said dissolving pulp may e.g. have a combined concentration of anhydromannose and anhydroxylose of 5 weight % or less of said carbohydrate content of said pulp product.

Other advantageous aspects may be that the kraft cooking process may be performed using white and/or black liquor as cooking liquor.

The pulp may be subjected to an oxygen delignifying step, the oxygen delignifying step may be performed before or after step c), e.g. during or after step b).

Step d) may comprise removing dissolved and degraded anhydromannose and anhydroxylose by dewatering the pulp. Step d) may comprise subjecting the pulp to washing and pressing in a washing press device, preferably 1-5 times.

The produced dissolving pulp may be after treated through etherification, nitration, acetylation, xanthation or other treatments, in order to provide different products. Just as a matter of example the produced dissolving pulp may be used for, from the product segment of ethers; food additives, binders, glues, pharmacy, oil drilling products. From nitrates; explosives, lacquers, celluloid. From acetates; filaments, tow, mouldings, films. From viscose; filaments, stable, cord and industrial yarn (all of which may be used in woven (textile) or in non-woven products), cellophane films, sponge products, comestible food casings such as sausage casings. Via other chemicals or treatments; cupra, lyocell, parchment, paper laminates, carboxymethyl cellulose (CMC), methyl cellulose (MC), hydroxypropyl cellulose (HPC), hydroxyethyl cellulose (HEC), papers and the like.

BRIEF DESCRIPTION OF THE DRAWINGS

Non-limiting embodiments of the present disclosure will be described in greater detail with reference to the accompanying drawings in which;

FIGS. 2-5 show tables of experimental data;

FIG. 8 shows a table of experimental data; and

DETAILED DESCRIPTION

Figure 1:
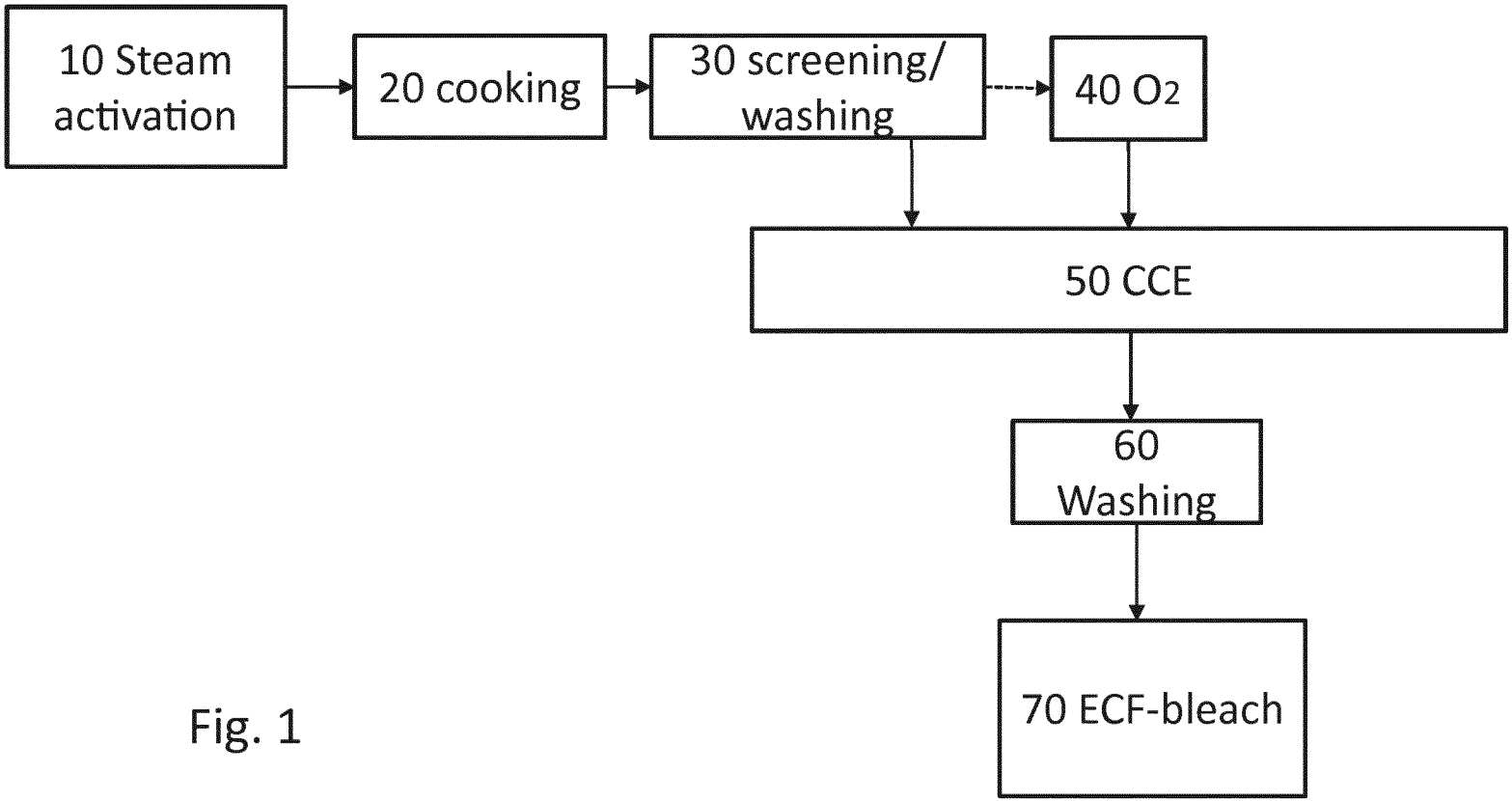
FIG. 1 shows a schematic process flow over a kraft cooking process including a hydrothermal treatment and a cold caustic extraction, and an optional bleaching step.

FIG. 1 schematically shows a process for manufacturing dissolving pulp. FIG. 1 shows schematically the steps of; 10 hydrothermal treatment, 20 cooking, 30 filtration/washing, 40 optional oxygen bleaching step and 50 a cold caustic extraction step (CCE). From the step 50, the CCE step, via an optional washing step 60, the pulp flow is ended with an optional step 70 ECF bleaching. The hydrothermal treatment and cooking may be performed in the same vessel, such as a digester, i.e. batch cooking. The hydrothermal treatment and cooking as may optionally be performed as a continuous process, e.g. a continuous cooking, and in such a case the hydrothermal treatment may be performed in a separate vessel prior to the cooking.

The dissolving pulp produced may be used in processes for manufacturing viscose, modal or lyocell fibers. Suitable applications for viscose, modal or lyocell fibres are textiles and non-woven products. Other products that can be produced by means of processes in which dissolving pulp is used as raw material are cellophane, tire cord, and various acetates and the like.

By the term "wood material" as used herein is meant wood in different unrefined forms such as wood chips, wood chunks, wood shavings, wood dust. Generally the wood material is screened to a suitable size. Bark and oversized wood chips may be removed if desirable. Wood material may be mechanically and/or chemically refined to pulp. The terminology thus used herein; pulp, or cellulose fibers per se, originates from wood material but is a refined premium material as compared to wood material.

With reference to FIG. 1 the process will be described in greater detail.

Mild Hydrothermal Treatment Step 10

The wood material is activated by performing a hydrothermal treatment with steam and/or hot water on the wood material. The hydrothermal treatment is in this case a lenient pre-hydrolysis of the wood material to achieve a specified P-factor for reasons as will be outlined below. As will be shown, a lenient hydrothermal treatment of the wood material prior to cooking, and optionally also oxygen delignification, followed by a cold caustic extraction will result in a dissolving pulp with a surprisingly high cellulose yield while maintaining the same pulp properties as during a conventional pre-hydrolysis Kraft pulp process.

The hydrothermal treatment may be performed by introducing steam at a selected temperature to a vessel containing the wood material or introducing wood material to a pressurized vessel comprising steam. A lower temperature generally requires a longer exposure time while a higher temperature generally shortens the required exposure time. To exemplify how the temperature influences the required time to reach a certain P-factor it can be mentioned that at constant temperature of 130° C., a P-factor of 150 is reached after 442 minutes of treatment time. In comparison at a constant temperature of 170° C., a P-factor of 150 is reached after 15 minutes treatment time. In practise the time to reach the selected maximum temperature will contribute to the obtained P-factor and especially at higher maximum temperatures, as the above example illustrates.

With reference to FIG. 1, the process may be performed in any suitable vessel or reactor. In accordance with the disclosed method, the hydrothermal treatment should be performed during a time and temperature giving a P-factor of from 100-300, preferably a P-factor of from 100-250.

Cooking—20

After the hydrothermal treatment, the treated wood material may be digested according to a kraft cooking process. White liquor may be added to the vessel and a traditional kraft cooking process may be performed. In the cooking step, wood material(s) are combined with white liquor in a vessel generally called a digester to effect delignification. The reaction intensity in cooking is expressed as the H-factor. An H-factor of 1 corresponds to cooking for one hour at 100° C. A suitable H-factor may be 600-1400. The H-factor is herein defined as $$H = \int_0^t e^{\left(43.2 - \frac{16115}{T}\right)} dt.$$

The white liquor used in the cooking may be, just as a matter of example, a caustic solution containing sodium hydroxide (NaOH) and at least one additive such as a sodium sulfide, or just NaOH. The property of the white liquor is expressed in terms of effective alkali (EA). The white liquor may be recycled from a process step downstream of the cooking step from the same process and/or from a second process at the same manufacturing site. Optionally or additionally the white liquor may be provided from a completely separate source.

During cooking, the wood material is pulped and the outcome is a brownish pulp generally referred to as "brown stock" and may comprise debris such as shives, and uncooked chips such as knots, dirt and the like.

With reference to the cooking step 20, when the hydrothermal treatment in step 10 is finished, cooking liquor such as white liquor (which in turn may be industrial white liquor) or a combination of black and white liquor, is charged to the vessel, and the temperature is increased to the selected cooking temperature. In the examples, which are non-limiting for the scope of the embodiments and the appended claims and which are described in greater detail below, pure industrial white liquor is used during digestion, and the liquor to wood ratio is adjusted to 4:1 using water.

Screening/Washing—30

The pulp may optionally be screened and washed to remove the debris until a satisfactory level is reached.

Optional Oxygen Delignifying Step—40 The kraft cooking process may be followed by an oxygen delignifying step. In this step, a part of the residual lignin is removed using oxygen and alkali. Impurities such as resin can be removed together with the dissolved remnants.

Cold Caustic Extraction (CCE) Step—50

In a CCE step, the delignified pulp is treated again with white liquor. The white liquor used in the CCE step may be, just as a matter of example, a caustic solution containing sodium hydroxide (NaOH) and at least one additive such as a sodium sulfide, or just NaOH. The CCE-step will reduce the anhydroxylose content in the pulp. CCE extracts anhydroxylose from the pulp, but is generally less effective on anhydromannose. In the CCE step sodium borate may optionally be included to increase extraction of anhydromannose but according to the present disclosure satisfactory anhydromannose removal can be accomplished without any use of borate. Just as a matter of example; the temperature may be kept at 40° C.-60° C. for at least 5 minutes, and wherein the alkali concentration in the liquid phase of said pulp suspension may be in the range from 60-150 g/l, preferably 70-120 g/l, more preferably 80-100 g/l.

Washing Step—60

A dewatering step and a washing step may be followed by a filtering step whereby the pulp is filtered in a wash filter. Dewatering and washing are done both to remove alkali and dissolved organic material from the CCE treated pulp. The dewatering step may follow directly on the CCE step. The liquor removed from the pulp by dewatering has a relatively high content of anhydroxylose and alkali, and can be used directly for recycling or to supplement a process liquid in a parallel pulp production process without further concentration or purification steps. Furthermore, the high anhydroxylose content in the liquor from the dewatering step makes the liquor highly suitable for further processing and as a anhydroxylose source. The washing step may be one or more of the following steps; pressing, vacuum filtering, screw press filtering, centrifugation or the like.

Depolymerization and Bleaching Step—70

After the CCE step the pulp may be bleached to necessary brightness using a normal industrial bleaching process for environmental reasons ECF (Elemental Chlorine Free) or TCF (Totally Chlorine Free) bleaching is preferred. However, bleaching sequences containing elemental chlorine containing steps may also be used. An acidic step, preferably with a pH of 1.5-3 without (A) or in combination with chlorine dioxide (D/A) may be advantageous to adjust pulp viscosity to a desirable level. Preferably, the pH may be adjusted to the desired level by addition of a mineral acid such as $H_2SO_4$, HCl and $HNO_3$. The process may optionally comprise a combined depolymerization and bleaching step or individual such steps. The combined depolymerization and bleaching step may alternatively be accomplished by an ozone treatment or by a hypochlorite treatment. The D/A step may be performed by first adding chlorine dioxide to the pulp and then adding sulfuric acid or by first adding sulfuric acid to the pulp and then adding chlorine dioxide, i.e. said addition may be performed sequentially in any order. An advantage with the method disclosed herein is that the cellulose in the pulp is comparatively easy to depolymerize, implying that the depolymerization step may be carried out at relatively mild conditions requiring less addition of acid, etc.

EXAMPLES

Non-limiting embodiments of the present disclosure will be described with reference to the following examples.

Example 1

9 different pulps were produced in the laboratory from Norway spruce sawmill chips (*Picea abies*). The process was performed using autoclaves for the mild hydrothermal treatment and cooking. The autoclaves were filled with 325 g dry weight of chips each and the liquor to wood ratio was adjusted to 2:1 using water. One exception was made for the reference, pulp 9, without hydrothermal treatment.

For the pulps including hydrothermal treatment the temperature, which at the start was 25° C., was increased in a controlled way to a selected maximum temperature for the hydrothermal treatment. The maximum temperature was chosen to get good control of the P-factor reading. The general temperature procedure was first 5 minutes at 25° C., thereafter the temperature was subsequently increased to 70° C. over a period of 30 minutes at a rate of 1.5° C./min. The temperature was stabilized at 70° C. for 10 minutes before further temperature increase. After stabilization, the treatment temperature was again increased using a temperature increase of 1.8° C./min up to desired temperature. When the maximum temperature was reached, the temperature was kept constant until the desired P-factor was reached. It should be noted that the temperature increase may be performed faster than in the present example. A slow temperature increase may however assist in providing an accurate P-factor reading.

FIG. 2 shows Table 1 comprising data derived from pulps 1-9 and the resulting pulp properties after cooking. Kappa numbers after oxygen delignification are also included in table 1.

After the hydrothermal treatment the autoclaves were rapidly cooled down to 45° C. using cool water before white liquor was charged to the autoclaves and liquor to wood ratio was adjusted to 4:1 using water. The alkali charge was varied between 19.5% EA, in the reference cooking without prior hydrothermal treatment, pulp no. 1 in FIG. 2 and Table 1, and 23% EA, in the normal pre-hydrolysis reference; pulp no. 9 in FIG. 2 and Table 1.

For all cookings the temperature was increased to a cooking temperature of 167° C., and H-factor was recorded with high accuracy using a similar procedure as for the hydrothermal step. Initially temperature was set to 45° C. at 5 minutes, subsequently increasing the temperature to 70° C. during 15 minutes (1.7° C./min). After 15 minutes at 70° C., the temperature was increased to cooking temperature (167° C.) during 2 hours (0.8° C./min). The cooking was then maintained until the wanted H-factor was reached, indicated in table 1 and FIG. 2. After the cook, residual alkali was determined, and after washing and screening, the kappa number, gravimetric yield and carbohydrate composition were determined.

After washing and screening, pulps 1-9 were further delignified in a two-step $O_2$-stage. This was done in autoclaves at a pulp consistency of 10%, with a NaOH charge of 35 kg/$t_{100}$ and a $MgSO_4$ charge of 5 kg/$t_{100}$ (kg per ton 100% dry pulp). One exception was made in reference pulp no. 9, standard PHK reference and P-factor 600, where the NaOH charge was 50 kg/$t_{100}$ and no $MgSO_4$ was charged. The temperature and residence time for the two-step $O_2$ delignification were 95° C. at 30 minutes and 105° C. at 60 minutes respectively. Kappa number and intrinsic viscosity were analysed for all pulps after the 02-stage.

All pulps except for the PHK reference i.e. pulp no. 9, were treated in a cold caustic extraction (CCE) step. In this step, $O_2$-delignified pulps were treated in plastic bags with varying charges of white liquor namely 70, 85 and 100 g EA/l (gram effective alkali per litre, calculated as NaOH) and sodium borate 0 and 40 g/l at a pulp consistency of 10% and temperature and residence time of 50° C. and 40 minutes, respectively. After the CCE-step, the pulps were washed and the carbohydrate compositions were analysed.

The results from example 1 series are shown in table 1 in FIG. 2. Table 2 in FIG. 3 shows data regarding the resulting carbohydrate composition in Pulps No. 1-8 after oxygen delignification and different treatments in a CCE-step. As can be seen in table 2 of FIG. 3, addition of sodium borate in the CCE-step is positive for the removal of anhydromannose from the pulp. However, this effect is most pronounced with no or very low hydrothermal treatment prior to the Kraft cooking. Furthermore, as sodium borate has a negative effect on removal of anhydroxylose from the pulp, the net positive effect on hemicellulose removal is quite small when a P-factor above 100 is utilised to reach the necessarily low total amount of hemicelluloses, shown in FIG. 7. In fact, to reach below 4.5%, preferably below 4%, in total hemicellulose content, i.e. anhydroxylose plus anhydromannose, a P-factor above about 100 is needed with or without borate addition.

Furthermore, Table 2 of FIG. 3 shows that when Pulp no. 1 was treated in the CCE-step with an industrially very high EA charge of 100 g/l in combination with a high charge of sodium borate (40 g/l), the resulting content of anhydroxylose and anhydromannose is too high for a good dissolving pulp. This confirms that some hydrothermal treatment is advantageous.

Example 2

Example 2 illustrates the present invention with respect to total yield of fully bleached pulp. Pulps no. 4, 5, 7 and 9 from Example 1 were bleached using a D/A-EP-D/Q-PO sequence. Between each bleaching step the pulps were washed with water.

The D/A step (acidic step in combination with chlorine dioxide) was performed at 90° C. and pulp consistency 10% for 150 minutes in plastic bags. The $ClO_2$ charge was 3.8 $kg/t_{100}$ (10 kg/t as active chlorine) and 4 kg $H_2SO_4/t_{100}$ was added.

The EP-step (alkaline extraction fortified with hydrogen peroxide) was performed in plastic bags at 80° C. and 10% pulp consistency for 80 minutes. The $H_2O_2$ and NaOH charges were 2 and 3 $kg/t_{100}$, respectively.

The D/Q (Chlorine dioxide bleaching step with a subsequent EDTA treatment without washing in between) was performed in plastic bags at 80° C. and 10% pulp consistency for 120 minutes in the D-step. The $ClO_2$ charge was 1.9 $kg/t_{100}$ (5 kg as active chlorine). Directly after the D-step, EDTA (0.5 $kg/t_{100}$) and NaOH (0.4-0.5 $kg/t_{100}$ depending on pH after the D-step) were charged to the pulp and allowed to react for 5 minutes before washing of the pulp.

The last bleaching step (the PO-step, pressurized peroxide bleaching) was performed at 90° C. and 10% pulp consistency for 90 minutes in autoclaves. NaOH and $Mg_SO_4$ charges were 13 and 1 $kg/t_{100}$, respectively, while the $H_2O_2$ charge was 5 $kg/t_{100}$.

After each process step (cooking, O2-bleaching, CCE, and the bleaching steps) yield was determined. The main results are summed up in table 3 and FIG. 4.

Figure 6:
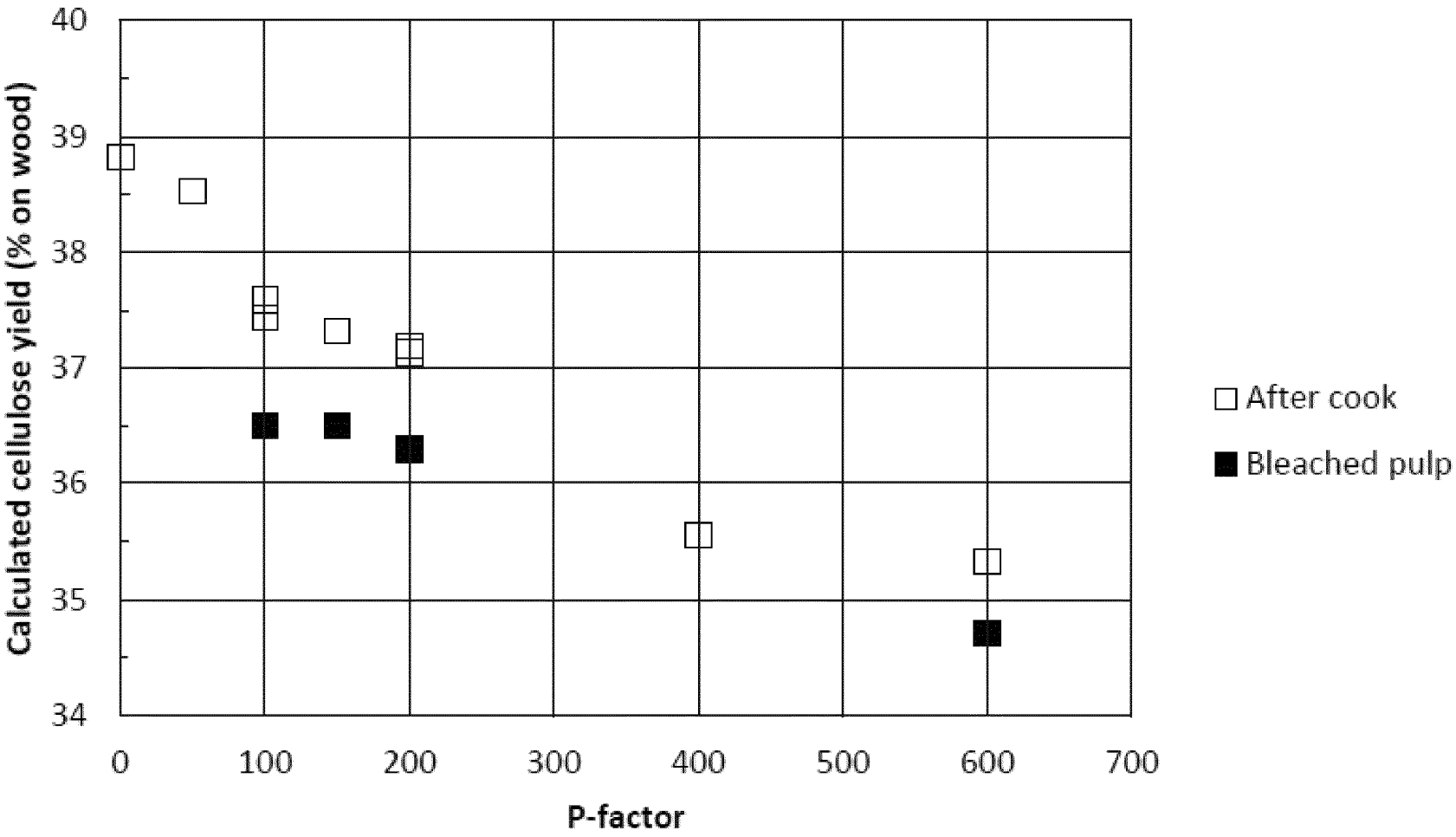
FIG. 6 shows a diagram over the calculated yield of cellulose as a percentage of wood material plotted against different P-factors.

FIG. 6 shows the relationship between the yields of cellulose pulp as a percentage of wood plotted against the P-factor. The trend in FIG. 6 is clear in that the yield of cellulose is decreasing with an increasing P-factor. FIG. 6 also shows that a CCE step will decrease the yield, as is indicated by the bleached pulp.

Table 3 of FIG. 4 shows the yield loss of Pulps no. 4, 5, 7 and 9 when subjected to oxygen delignification, cold caustic extraction (CCE) and bleaching. The relative neutral carbohydrate composition as well as the calculated cellulose yield is also included in the Table. In the case of reference Pulp no. 9, conventional PHK-pulp, no CCE-step was performed.

Table 3 shows that the total yield of the Pulps no. 4, 5 and 7 combining a mild hydrothermal treatment and a CCE step surprisingly was considerably higher than for the pulp produced using a classic PHK-process, P-factor 600, Pulp no. 9, even at similar content of anhydroxylose and anhydromannose. A positive effect due to the present invention is also that the final product contains less anhydroxylose (pentosan) than a standard PHK pulp from the same raw material. Most of the difference in yield is due to a higher cellulose yield. This is also shown graphically in FIG. 6.

Table 4 of FIG. 5 shows quality parameters for pulps no. 4, 5 and 7 produced according to the present invention and Pulp no. 9 produced using a classic PHK-process. For comparison, data for commercial viscose grade PHK pulps are included in the table.

In total, pulp quality is very similar to commercial viscose grades, PHK and acid sulfite. Furthermore, the results in Table 4 in combination with the results in Table 3 show that a high quality viscose pulp with a considerably higher pulp yield (on wood), as compared to softwood PHK-pulp produced by the classical PHK-process, Pulp no. 9, is obtained when a method according to the present invention is used, such as Pulp no. 4, 5 and 7.

Figure 7:
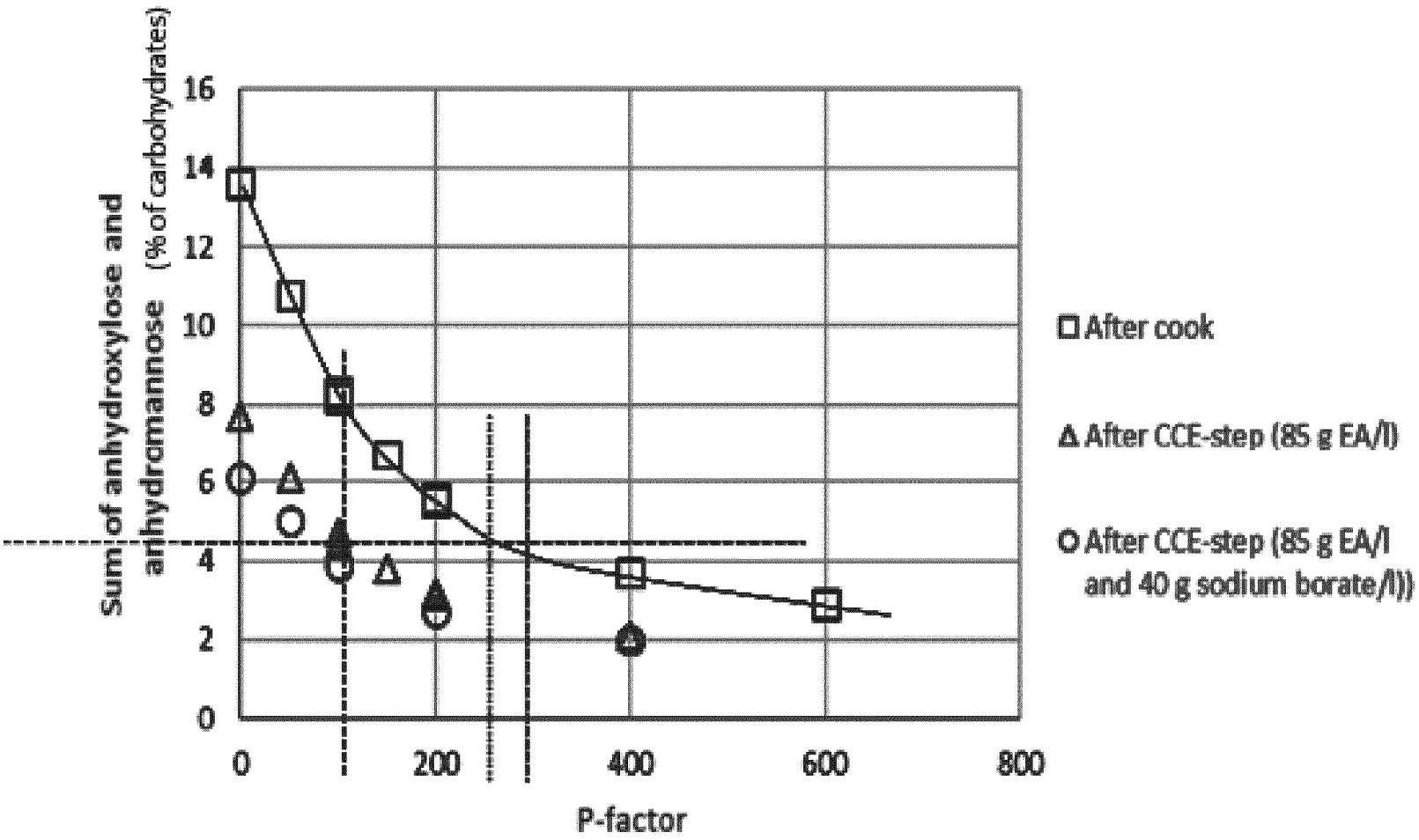
FIG. 7 shows a diagram over the concentration of anhydromannose; anhydroxylose as a percentage of carbohydrates plotted against different P-factors.

FIG. 7 shows the amount of anhydromannose and anhydroxylose concentration plotted against the P-factor. It further shows the reference example 1 of a pure cooking and when using borate 40 g/l. As is noticeable, adding borate in the process has a surprisingly small additional effect on the reduction of the total amount of anhydromannose and anhydroxylose when applying the method according to the present invention. It is shown that when using the method as disclosed herein, the combined amount of anhydromannose and anhydroxylose is still being significantly reduced as compared to the reference example no. 1 when no borate is added.

Example 3

The bleached pulps from Example 2 were analysed and compared with industrial viscose grade dissolving pulps. Brightness, carbohydrate composition, acetone extractives and alkali resistance of the pulps are compared with data from Sixta et al, Handbook of pulp, pp. 1061-1062, Wiley-VCF Verlag GmbH & Co. KGaA, 2006 are shown in table 4 of FIG. 5. As can be seen, a pulp according to the present invention is comparable to both a viscose grade PHK pulp and an acid sulfite dissolving pulp. Pulp no. 7 is lower than, or at the same level, in total hemicelluloses content, expressed as the content of anhydroxylose and anhydromannose, as the commercial references. Even the alkali resistance for Pulp no. 5 and 7 is at least at the same level ($R_{18}$) or higher ($R_{10}$) as the commercial references, indicating a high yield and performance in the viscose process.

Hence although hydrothermal treatment as illustrated in Table 3 of FIG. 4 appears to be negative for cellulose yield, it has been found that a mild hydrothermal treatment to a P-factor of between 100-300, preferably 100-250, in combination with a cold caustic extraction step can lower the contents of anhydroxylose and anhydromannose to such low levels that the resulting pulp is suitable for viscose production at relatively high cellulose yield. The effects on anhydroxylose and anhydromannose removal and cellulose yield are illustrated in FIG. 7 and FIG. 6, respectively.

The new method provides for a surprisingly good balance between process time, energy input and quality of the yielded dissolving pulp.

Example 4

Also the shape factor was measured for pulps made according to the method of the present invention (pulps 4, 5 and 7). In addition also this shape factor was measured for a reference pulp (pulp 9). The pulps were also both (in its final form) in dry form and in wet form, respectively. These measurements were done using Lorentzon & Wettre "Fibre Tester". The results can be seen in table 5, FIG. 8. The Shape factor was measured using image analysis of the fibers, and a L & W Fiber Tester-code 912 was used in the present analyses.

Figure 9:
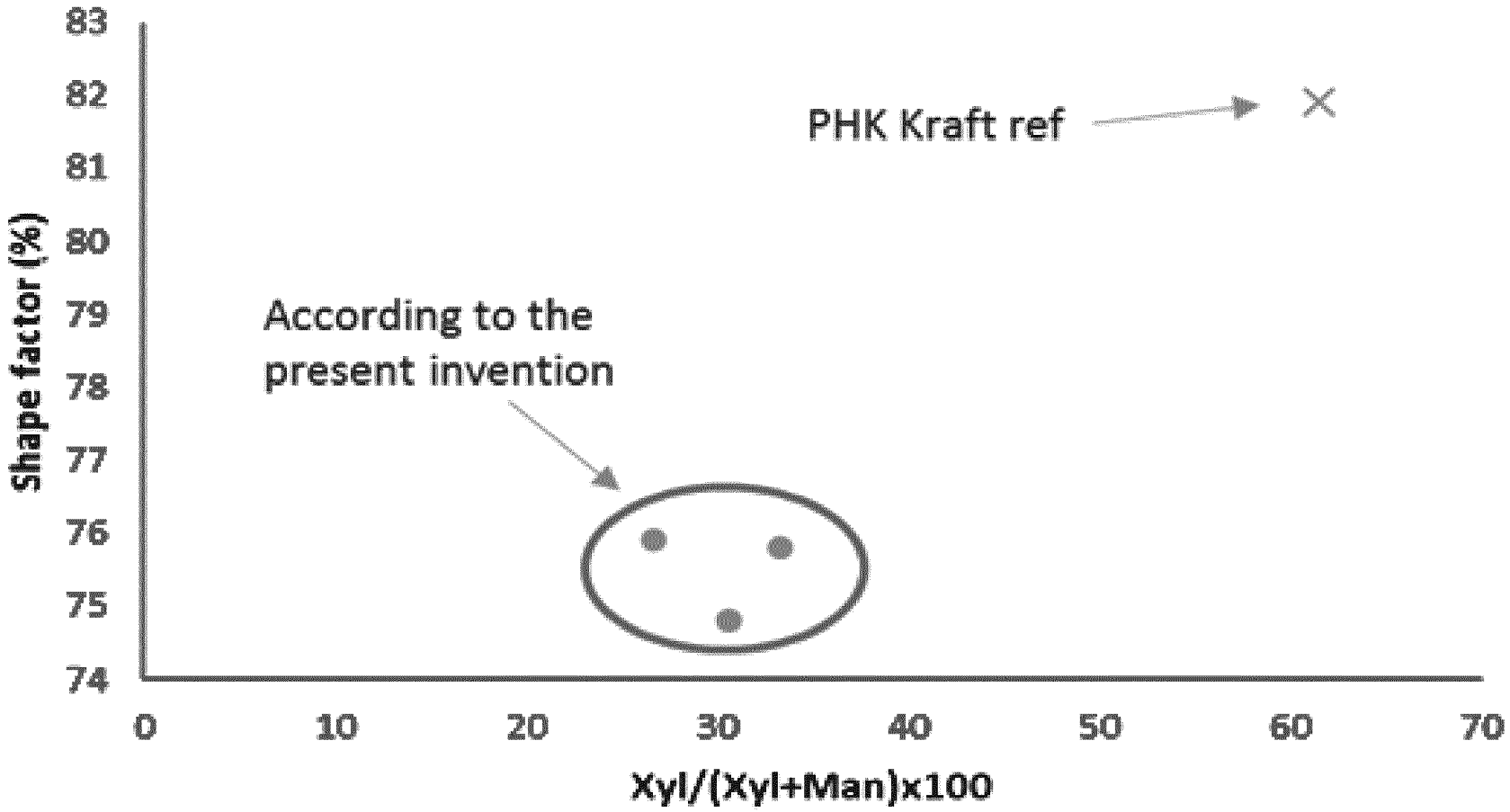
FIG. 9 shows a diagram with the shape factor plotted against Xyl/(Xyl+Man)×100.

Also ratios for anhydroxylose (Xyl) in relation to Anhydromannose (Man) and anhydroxylose (Xyl) are given (the ratios are given as: Xyl/(Xyl+Man)×100) in the same table 5. These values in table 5 are further reflected in FIG. 9.

Measuring Methods

The following methods were used.

| | |
|---|---|
| EA (effective alkali) | SCAN N 30: 85 |
| Residual EA | SCAN N 33: 94 |
| Kappa number | ISO 302: 2004 |
| Brightness | ISO 24: 70 |
| Intrinsic viscosity | ISO 5351: 2010 |
| Carbohydrate composition | SCAN CM 71: 09 |
| Extractives | ISO 14453: 2014 |
| $R_{10}$ and $R_{18}$ | ISO 699: 1982 |

Calculation of Cellulose Yield

The gravimetric pulp yield, $Y_{pulp}$, was determined by dividing the dry weight of the pulp with the weight of the dry wood material used to produce the actual pulp sample. The cellulose yield was calculated by first calculating the lignin-free yield as percentage of dry wood material used in the process, $Y_{lignin\text{-}free}$, which is considered to represent the carbohydrate yield. In this calculation one kappa number unit is assumed to correspond to 0.15% lignin in the sample (Kleppe, P., 1970, Tappi Journal 53(1), 35-47).

$$Y_{lignin\text{-}free}=Y_{pulp}(1-\text{kappa number}*0.15/100)(\%\text{ on wood})$$

The carbohydrate analysis gives concentrations of anhydroglucose, $C_{glu}$, and anhydromannose, $C_{man}$, as the percentage of the carbohydrates in the pulp sample. Most of the anhydroglucose originates from cellulose, but a minor part originates from the hemicellulose glucomannan. The ratio of anhydroglucose to anhydromannose in the pulp samples glucomannan was set to 1:4.2 (Janson, J., 1974, Faserforschung and Textiltechnik, 25, 379-380). In order to calculate the content of cellulose, the part of the anhydroglucose present in glucomannan was calculated and then subtracted from the total anhydroglucose content.

$$\text{Calculated cellulose yield}=Y_{lignan\text{-}free}*(C_{glu}-C_{man}/4.2)/100(\%\text{ on wood})$$

The invention claimed is:

1. A method for manufacturing dissolving pulp using wood material, said method comprising the steps of;

a) subjecting said wood material to a hydrothermal treatment using steam and/or water, b) digesting said wood material obtained from step a) to a pulp in a kraft cooking process;

c) subjecting said pulp to a cold caustic extraction CCE; and d) dewatering, washing and pressing said pulp to get a pulp product having a carbohydrate content, characterized by that said wood material is a coniferous wood material, and whereby said hydrothermal treatment is performed until a P-factor of from 100-300 is reached, and whereby said cold caustic extraction is executed to reach a combined concentration of anhydromannose and anhydroxylose of 5 weight % or less of said carbohydrate content of said pulp product.

2. The method according to claim 1, whereby said hydrothermal treatment is performed to until a P-factor of from 100-250 is reached.

3. The method according to claim 1, whereby said cold caustic extraction is executed such that the resulting anhydromannose concentration and anhydroxylose concentration of said pulp product is ≤4.0 weight % of the carbohydrate content of said pulp product.

4. The method according to claim 1, whereby said wood material obtained from step a) is treated until the anhydromannose concentration is from 1.5-3.5 weight % of the carbohydrate content in said pulp product.

5. The method according to claim 1, whereby said wood material obtained from step a) is treated until the anhydroxylose concentration is from 1.0-1.5 weight %, of the carbohydrate content in said pulp product.

6. The method according to claim 1, whereby said cold caustic extraction step comprises one or more of the steps of;

adding industrial white liquor to said pulp;

the temperature is kept at 40° C.-60° C. for at least 5 minutes, and wherein the alkali concentration in the liquid phase of said pulp suspension is in the range from 60-150 g/l.

7. The method according to claim 1, whereby said wood material comprises;

at least 8 weight % of anhydromannose, 12 weight % or less of anhydroxylose, and the remaining material being other wood ingredients such as cellulose, lignin, extractives and other carbohydrates.

8. The method according to claim 1, whereby said wood material is at least one coniferous wood material selected from the list of; spruce, pine, fir, larch and hemlock.

9. The method according to claim 1, whereby said P-factor is determined using the formula;

$$P-factor=\int_0^t \frac{k(T)}{k_{100°\,C.}}dt=\int_0^t e^{40.48-\frac{15106}{T}}dt$$

wherein T is temperature in Kelvin and t is treatment time in hours.

10. The method according to claim 1, whereby said P-factor is reached by a heat treatment at a selected temperature for a selected period of time.

11. The method according to claim 1, whereby said P-factor is reached by a treatment at one or more of the following parameters; treatment at about 130° C. for about 442 to 884 minutes, at about 140° C. for about 179 to 357 minutes, at about 150° C. for about 75 to 151 minutes, at about 160° C. for about 33 to 66 minutes and/or at about 170° C. for about 15 to 30 minutes.

12. The method according to claim 1, whereby said kraft cooking process is performed using white and/or black liquor as cooking liquor.

13. The method according to claim 1, whereby said pulp is subjected to an oxygen delignifying step, said oxygen delignifying step being performed before or after step c).

14. The method according to claim 1, whereby step d) comprises removing dissolved and degraded anhydromannose and anhydroxylose by dewatering said pulp.

15. The method according to claim 1, whereby step d) comprises subjecting said pulp to washing and pressing in a washing device.

* * * * *